US005464733A

United States Patent [19]

Friday

[11] Patent Number: 5,464,733

[45] Date of Patent: Nov. 7, 1995

[54] PHOTOGRAPHIC MATERIAL HAVING REDUCED FOG

[75] Inventor: James A. Friday, Rochester, N.Y.

[73] Assignee: Eastman Kodak Company, Rochester, N.Y.

[21] Appl. No.: 9,367

[22] Filed: Jan. 26, 1993

Related U.S. Application Data

[63] Continuation of Ser. No. 870,139, Apr. 16, 1992, abandoned.

[51] Int. Cl.[6] ..... G03C 1/46

[52] U.S. Cl. ..... 430/507; 430/510; 430/511; 430/512; 430/505; 430/544; 430/551; 430/955; 430/431

[58] Field of Search ..... 430/507, 510, 430/511, 512, 544, 505, 431, 551, 955

[56] References Cited

U.S. PATENT DOCUMENTS

| | | | |
|---|---|---|---|
| 4,163,669 | 8/1979 | Kanada et al. | 430/393 |
| 4,842,994 | 6/1989 | Sakanoue et al. | 430/955 |
| 4,923,784 | 5/1990 | Harder et al. | 430/430 |
| 4,923,787 | 5/1990 | Harder | 430/489 |
| 4,927,744 | 5/1990 | Henzel et al. | 430/505 |
| 4,946,767 | 8/1990 | Yamagami | 430/505 |
| 5,314,793 | 5/1994 | Chang et al. | 430/506 |

FOREIGN PATENT DOCUMENTS

| | | |
|---|---|---|
| 310125 | 4/1989 | European Pat. Off. . |
| 456181 | 11/1991 | European Pat. Off. . |

*Primary Examiner*—Charles L. Bowers, Jr.
*Assistant Examiner*—Geraldine Letscher
*Attorney, Agent, or Firm*—Arthur E. Kluegel

[57] ABSTRACT

Disclosed is a multilayer color photographic element comprising a support having coated thereon photographic silver halide emulsion layers, the layers including blue sensitive, green sensitive and red sensitive layers, the photographic element comprising at least one of a bleach accelerating releasing coupler and a bleach accelerating silver salt in at least one layer of the photographic element and a layer containing finely divided silver. An interlayer is disposed between the layer containing finely divided silver and a layer containing dye forming coupler.

7 Claims, No Drawings

PHOTOGRAPHIC MATERIAL HAVING REDUCED FOG

This is a continuation of application Ser. No. 07/870,139 filed Apr. 16, 1992, now abandoned.

This invention relates to a photographic material having multiple color layers comprising at least one of a bleach accelerating releasing coupler and a bleach accelerating silver salt separated from a finely divided silver layer by an interlayer.

Color photographic materials comprising multiple layers containing photographic couplers are well known. Typical photographic materials are described in U.S. Pat. Nos. 4,145,219; 4,724,198; 4,184,876; 4,186,016 and 4,724,198.

Prior photographic materials have exhibited problems with exposure reciprocity, speed, retained silver, color reproduction and neutral gray scale, flesh tones reproduction and image structure or granularity.

Further, when bleach accelerating releasing couplers are used in a photographic element in the presence of layers containing finely divided silver such as the antihalation layer (AHU) or a yellow filter layer, problems have been experienced with increases in fog or Dmin.

Various ways have been recognized in the photographic art for improving these problems. That is, for example, granularity can be improved but often it can be at the expense of another property such as speed. Or flesh tone color reproduction can be improved but neutral gray scale can be adversely affected. Thus, there is a great need for a photographic material which enables improvement in these properties without serious adverse affects.

With respect to the increase in fog, the present invention solves these problems by providing a multilayer color photographic element comprising a support having coated thereon photographic silver halide emulsion layers, the layers including blue sensitive, green sensitive and red sensitive layers, the photographic element comprising at least one of a bleach accelerating releasing coupler and a bleach accelerating silver salt in at least one layer of the photographic element; a layer containing finely divided silver, and an interlayer disposed between the layer containing finely divided silver and a layer containing dye forming coupler.

Also, there is provided a multilayered color photographic element comprising a support having coated thereon photographic silver halide emulsion layers said layers including at least three green sensitive and at least two blue sensitive layers, the blue sensitive layers being the emulsion layers farthest from the support. The first of said green sensitive layers is the green sensitive layer farthest from the support, the second of said green sensitive layers being less green sensitive than the first green sensitive layer, the third of said green sensitive layers being the green sensitive layer closest to the support and being less green sensitive than said second green sensitive layer, the green sensitive layers being adjacent. The first of said blue sensitive layers is the most sensitive blue layer and being the emulsion layer farthest from the support, the first blue sensitive layer being a coupler starved layer, and being free of yellow image dye-forming coupler, the second blue sensitive layer being contiguous said first blue sensitive layer.

The first blue sensitive layer comprised of a timed development inhibitor development coupler; the second blue sensitive layer is comprised of a yellow image dye-forming coupler.

Further, the multilayer color photographic element comprises the support having coated thereon photographic silver halide emulsion layers, the layers including a unit of at least three green sensitive silver halide emulsion layers having a first green sensitive layer being more sensitive than a second or mid green sensitive layer which is more sensitive than a third green sensitive layer, the green sensitive layers being adjacent and the unit containing a masking coupler. The first green sensitive layer is comprised of at least one magenta image dye-forming coupler (A), a timed development inhibitor releasing coupler, and preferably a non-timed development inhibitor releasing coupler. The second layer is comprised of at least one first magenta image dye-forming coupler, (A), preferably at least one second magenta image dye-forming coupler, a development inhibitor releasing coupler and preferably a cyan dye-forming coupler. The third layer is comprised of at least one magenta image dye-forming coupler which is also a bleach accelerating releasing coupler. Further, the third layer contains a development inhibitor releasing coupler.

A typical photographic element in accordance with the invention typically comprises the following layer order:

| |
|---|
| OVERCOAT |
| UV |
| MOST SENSITIVE BLUE OR FAST YELLOW |
| LEAST SENSITIVE BLUE OR SLOW YELLOW |
| INTERLAYER |
| MOST SENSITIVE GREEN OR FAST MAGENTA |
| MID SENSITIVE GREEN OR MID MAGENTA |
| LEAST SENSITIVE GREEN OR SLOW MAGENTA |
| INTERLAYER |
| MOST SENSITIVE RED OR FAST CYAN |
| LEAST SENSITIVE RED OR SLOW CYAN |
| INTERLAYER |
| ANTIHALATION LAYER |
| SUPPORT |

The overcoat layer can be comprised of components known in the photographic art for overcoat layers including UV absorbers, matting agents, surfactants, and like. A UV layer can also be used which contains similar materials. UV absorbing dyes useful in this layer and the antihalation layer have the structure:

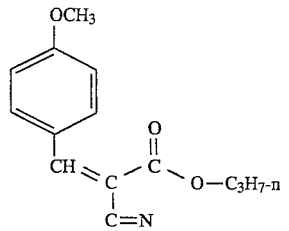

(1)

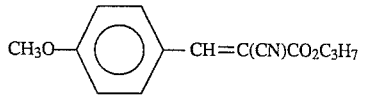

(2)

This layer, for example, also can contain dyes which can help in adjusting the photographic sensitivity of the element. Such dyes can be a green filter dye. A suitable green filter dye has the structure (10)

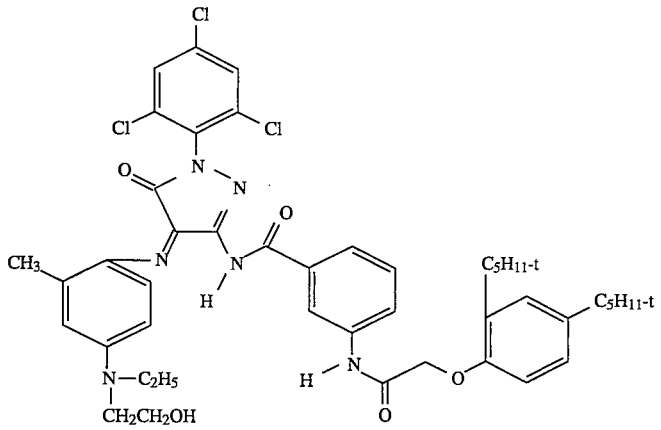

A suitable red filter dye has the structure (20)

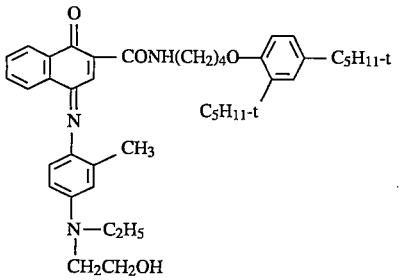

Other dyes that may be used include washout dyes of the type referred to herein and filter dyes that decolorize during the photographic process.

IMAGE DYE FORMING COUPLERS

The image dye-forming couplers in the blue-sensitive, green-sensitive and red sensitive layers as described can be any of the image dye-forming couplers known in the photographic art for such layers for forming yellow, magenta and cyan dye images. Such couplers can comprise a coupler moiety (COUP) known in the art and as described. Combinations of the image dye-forming couplers can be useful in the described photographic silver halide emulsion layers.

Couplers that are yellow dye forming couplers are typically acylacetamides, such as benzoylacetanilides and pivalylacetanilides. Such couplers are described in such representative patents and publications as: U.S. Pat. Nos. 2,875,057; 2,407,210; 3,265,506; 2,298,443; 3,048,194; 4,022,620; 4,443,536; 3,447,928 and "Farbkuppler: Eine Literatürbersicht", published in Agfa Mitteilungen, Band III, pages 112–126 (1961).

The couplers that are cyan image dye-forming couplers (C) are typically phenols or naphthols, such as described in the photographic art for forming cyan dyes upon oxidative coupling.

Examples of such couplers (C) that form cyan dyes are typically phenols and naphthols that are described in such representative patents and publications as: U.S. Pat. Nos. 2,772,162; 3,772,002; 4,526,864; 4,500,635; 4,254,212; 4,296,200; 4,457,559; 2,895,826; 3,002,936; 3,002,836; 3,034,892; 2,474,293; 2,423,730; 2,367,531; 3,041,236; 4,443,536; 4,124,396; 4,775,616; 3,779,763; 4,333,999 and "Farbkuppler: Eine Literatürbersicht", published in Agfa Mitteilungen, Band III, pages 156–175 (1961).

Examples of couplers (A) that form magenta dyes are typically pyrazolones, pyrazolotriazoles and benzimidazoles, such couplers are described in such representative patents and publications as U.S. Pat. Nos. 2,600,788; 2,369,489; 2,343,703; 2,311,082; 3,824,250; 3,615,502; 4,076,533; 3,152,896; 3,519,429; 3,062,653; 2,908,573; 4,540,654; 4,443,536; 3,935,015; 3,451,820; 4,080,211; 4,215,195; 4,518,687; 4,612,278; and European Applications 284,239; 284,240; 240,852; 177,765 and "Farbkuppler: Eine Literatürbersicht", published in Agfa Mitteilungen, Band III, pages 126–156 (1961).

The photographic element may be processed to form a developed image in an exposed color photographic element by developing the element with a color developer.

FAST YELLOW

In the photographic element, the more blue sensitive layer or fast yellow layer contains a timed development inhibitor releasing coupler (DIR). The fast yellow layer is a coupler starved layer. The layer is preferably free of an image dye-forming coupler. As used herein by coupler starved is meant a condition in the layer in which there is less dye-forming coupler than is theoretically capable of reacting with all of the oxidized developing agent generated at maximum exposure. Couplers other than image dye-forming couplers can be present in this layer and such couplers can include, for example, timed development couplers as noted or non-timed DIR couplers and color correcting couplers. These other couplers are typically used at concentrations known in the photographic art and can produce yellow dye typically not more than about 3% of the total density of the yellow record.

Suitable timed DIR couplers used in the fast yellow layer comprise a DIR coupler (E) that is capable of releasing a mercapto-tetrazole development inhibitor comprising a substituent:

—X—COOR wherein

X is alkylene of 1 to 3 carbon atoms and R is alkyl of 1 to 4 carbon atoms, and the sum of the carbon atoms X and R is 5 or less. The DIR coupler is typically a pivalylacetanilide coupler, such as described in U.S. Pat. No. 4,782,012, the disclosure of which is incorporated herein by reference.

The timed DIR coupler can be any timed DIR coupler useful in the photographic art which will provide a timed development inhibitor release.

That is, a development inhibitor releasing coupler containing at least one timing group (T) that enables timing of release of the development inhibitor group can be any development inhibitor releasing coupler containing at least one timing group known in the photographic art. The development inhibitor releasing coupler containing at least one timing group is represented by the formula:

$$\text{COUP}-\text{T}\left[\text{T}^1\right]_n\text{Q}^1$$

wherein

COUP is a coupler moiety, as described, typically a cyan, magenta or yellow dye-forming coupler moiety;

T and $T^1$ individually are timing groups, typically a timing group as described in U.S. Pat. Nos. 4,248,962 and 4,409,232, the disclosure of which are incorporated herein by reference;

n is 0 or 1; and $Q^1$ is a releasable development inhibitor group known in the photographic art. $Q^1$ can be selected from the INH group as described.

A preferred coupler of this type is described in U.S. Pat. No. 4,248,962. Preferred timed DIR couplers of this type are:

(24)

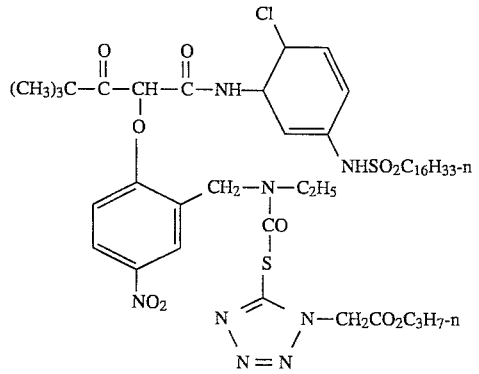

(25)

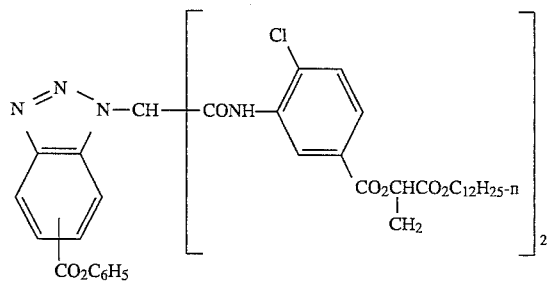

(26)

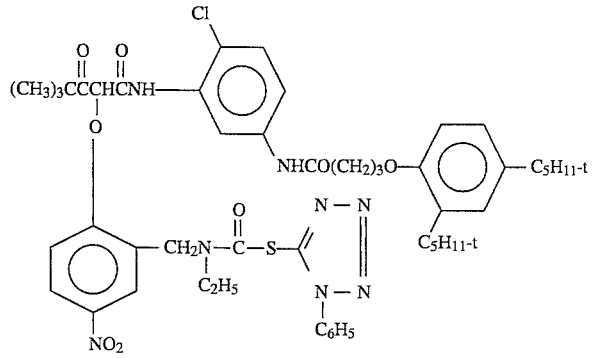

Highly suitable timed DIR couplers have the structure:

(17)

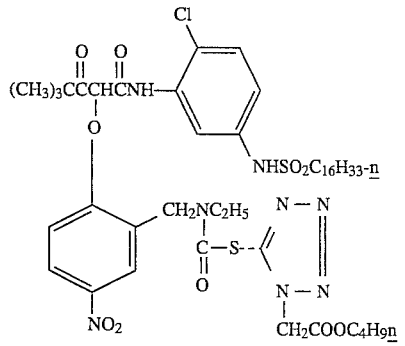

-continued (27)

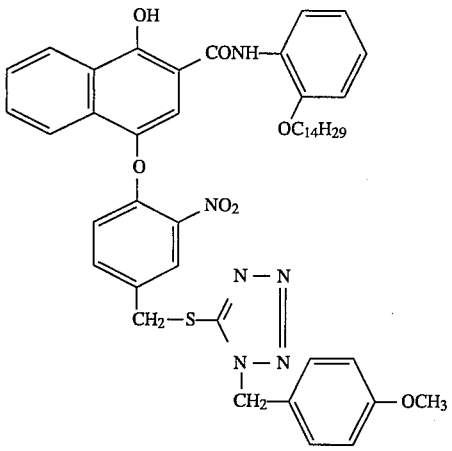

(28)

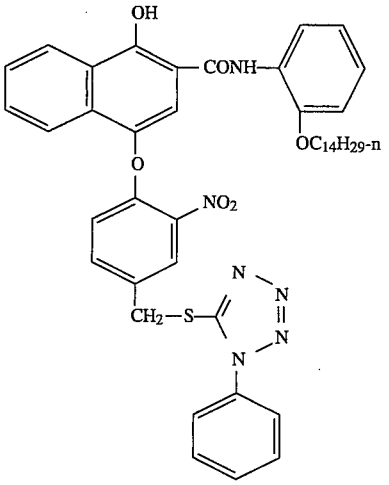

Color from the fast yellow layer is produced mostly as a result of oxidized developer formed in the fast yellow layer migrating to the adjacent slow yellow layer and reacting to form yellow dye.

Other couplers that are development inhibitor releasing couplers as described include those described in for example U.S. Pat. Nos. 4,248,962; 3,227,554; 3,384,657; 3,615,506; 3,617,291; 3,733,201; and U.K. 1,450,479. Preferred development inhibitors are heterocyclic compounds, such as mercaptotetrazoles, mercaptotriazoles, mercaptooxadiazoles, selenotetrazoles, mercaptobenzothiazoles, selenobenzothiazoles, mercaptobenzoxazoles, selenobenzoxazoles, mercaptobenzimidazoles, selenobenzimidazoles, benzotriazoles, benzodiazoles and 1,2,4-triazoles, tetrazoles, and imidazoles.

SLOW YELLOW LAYER

In the photographic element, the less blue sensitive layer or slow yellow layer contains a yellow image dye-forming coupler. Such yellow image dye-forming coupler can be any yellow dye-forming coupler useful in the photographic art.

Couplers that are yellow image dye-forming couplers are typically acylacetamides, such as benzoylacetanilides and pivalylacetanilides, such as described in the photographic art for forming yellow dyes upon oxidative coupling.

The yellow dye-forming coupler in the slow yellow layer is typically a pivalylacetanilide coupler containing a hydantoin coupling-off group. Such a coupler is illustrated by the formula:

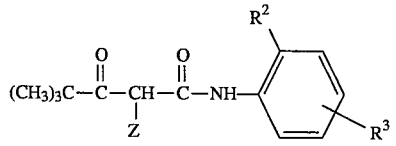

wherein $R^2$ is chlorine, bromine or alkoxy;

$R^3$ is a ballast group, such as a sulfonamide or carboxamide ballast group; and Z is a coupling-off group, preferably a hydantoin coupling off group as described in U.S. Pat. No. 4,022,620, the disclosure of which is incorporated herein by reference.

Yellow dye-forming couplers suitable for the slow yellow or less sensitive blue layer are:

(6)

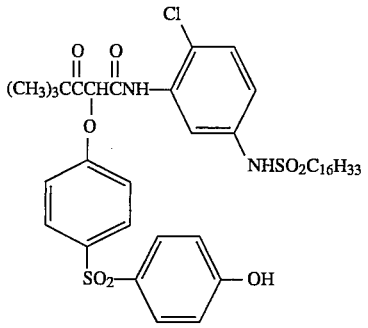

(29)

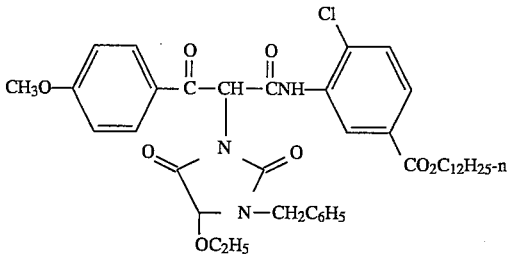

(30)

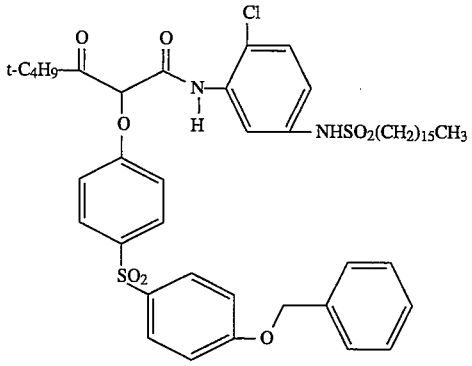

A preferred yellow dye-forming coupler yellow layer has the structure:

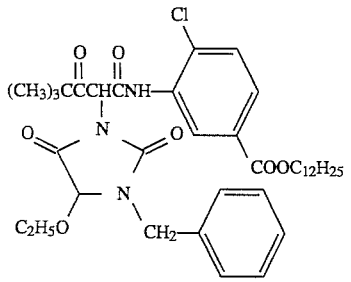

(19)

Timed or non-timed DIR couplers as noted with respect to the fast yellow layer may also be used in the slow yellow lower.

INTERLAYER

In the photographic element a yellow filter layer is provided between the slow yellow and the fast magenta. This layer can comprise Carey Lea silver (CLS), bleach accelerating silver salts, any oxidized developer scavenger known in the photographic art, such as described in U.S. Pat. No. 4,923,787, and a dye to enable improved image sharpness or to tailor photographic sensitivity of the element. A preferred oxidized developer scavenger is:

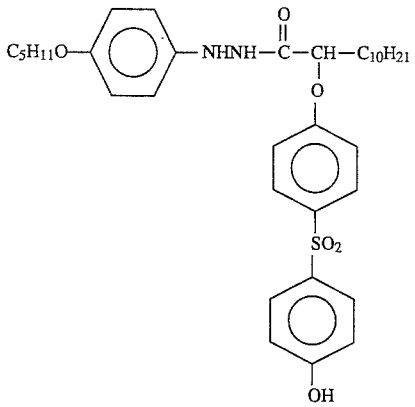

(3)

Other oxidized developer scavenger useful in the invention include:

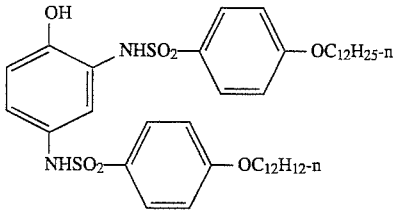

(31)

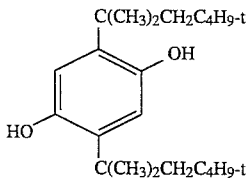

(32)

When finely divided silver such as Carey Lea silver is used in the yellow filter layer and the photographic element contains a BARC, then preferably an interlayer is provided between the yellow filter and any other layer that contains a dye forming coupler. If a bleach accelerating silver salt (BASS) is used, preferably in the yellow filter layer, then it is preferred to provide an interlayer to isolate the BASS containing layer from the remainder of the film. This interlayer may contain the oxidized developer scavenger noted above. Further, the interlayer may be contiguous with the yellow filter layer and may be disposed on both sides of the yellow filter layer. Representative bleach accelerating silver salts are disclosed in U.S. Pat. Nos. 4,865,965; 4,923,784; 4,163,669. The bleach accelerating silver salts can comprise silver salts of mercapto proprionic acid.

BARC and BASS compounds may be used in combination in the element.

Other representative bleach accelerating silver salts which may be used in the interlayer are structurally shown as follows:

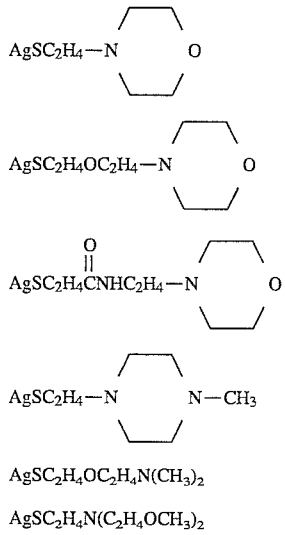

Instead of using finely divided silver in the yellow filter layer, filter dyes may be used. When filter dyes are used, then the interlayer contiguous or adjacent the yellow filter layer may be omitted. Oxidized developer scavenger as referred to above may be used in the yellow filter layer with the filter dye. Examples of filter dyes such as washout or decolorizing dyes useful in the present invention are described in U.S. Pat. No. 4,923,788 incorporated herein by reference. Such filter dyes have the formula:

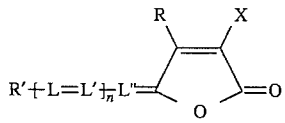

wherein R is substituted or unsubstituted alkyl or aryl, X is an electron withdrawing group, R' is substituted or unsubstituted aryl or a substituted or unsubstituted aromatic heterocyclic nucleus, and L, L', and L" are each independently a substituted or unsubstituted methine group.

Preferred alkyl groups include alkyl of from 1 to 20 carbon atoms, including straight chain alkyls such as methyl, ethyl, propyl, butyl, pentyl, decyl, dodecyl, and so on, branched alkyl groups such as isopropyl, isobutyl, t-butyl, and the like. These alkyl groups may be substituted with any of a number of known substituents, such as sulfo, sulfato, sulfonamide, amido, amino, carboxyl, halogen, alkoxy, hydroxy, phenyl, and the like. The substituents may be located essentially anywhere on the alkyl group. The possible substituents are not limited to those exemplified, and one skilled in the art could easily choose from a number of substituted alkyl groups that would provide useful compounds according to the formula.

Preferred aryl groups for R include aryl of from 6 to 10 carbon atoms (e.g., phenyl, naphthyl), which may be substituted. Useful substituents for the aryl group include any of a number of known substituents for aryl groups, such as sulfo, sulfato, sulfonamido (e.g., butane-sulfonamido), amido, amino, carboxyl, halogen, alkoxy, hydroxy, acyl, phenyl, alkyl, and the like.

The filter dyes may be used in combination with the finely divided silver.

It will be appreciated that permanent yellow filter dyes can be used instead of CLS or washout-filter dyes, such permanent dyes, for example, have structures:

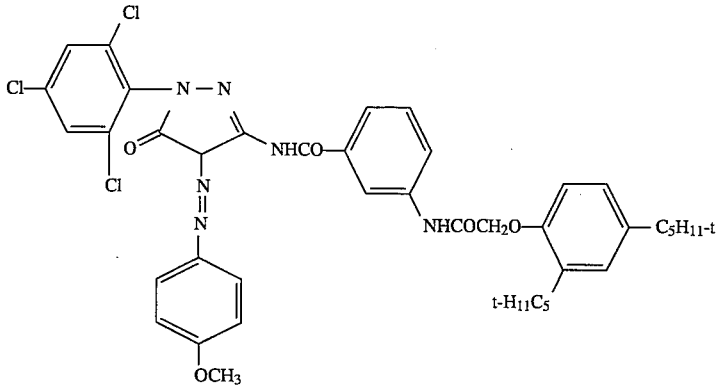

(33)

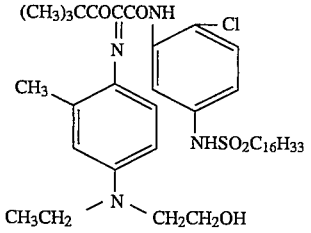

(11)

A decolorizing microcrystalline dye useful in the invention has the structure:

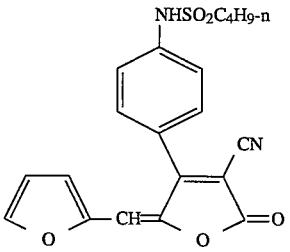

(18)

FAST MAGENTA LAYER

The most green sensitive layer or fast magenta layer comprises a magenta image dye-forming coupler (A), a timed development inhibitor releasing coupler (DIR), preferably a non-timed DIR coupler and preferably a masking coupler.

The magenta image dye-forming coupler (A) can be any image forming coupler dye useful in the photographic art.

A typical magenta image dye-forming coupler is a pyrazolotriazole. Suitable couplers that form magenta dyes include:

(34)
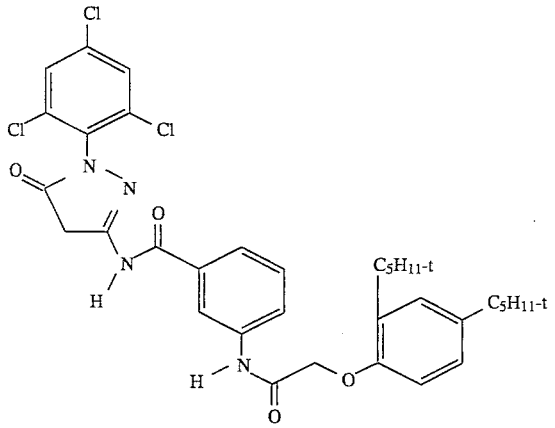
(14)
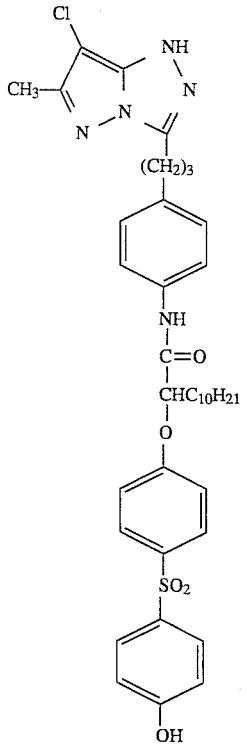
(35)
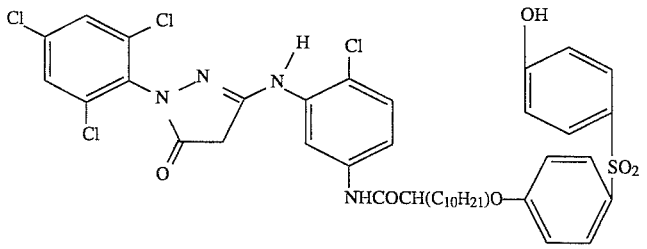

-continued (36)

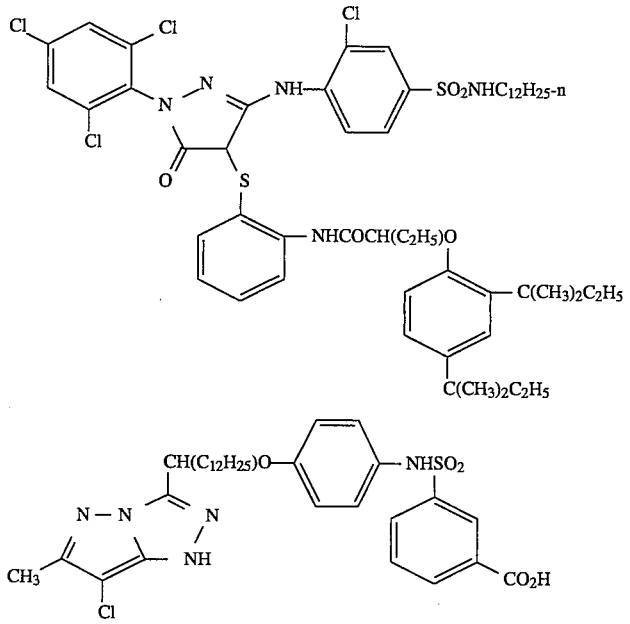

A preferred magenta image dye-forming coupler has the structure:

(15)

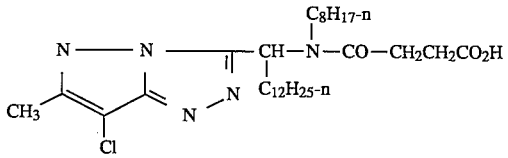

Suitable timed DIR couplers comprise a DIR coupler (E) that is capable of releasing a mercaptotetrazole development inhibitor as noted with respect to the fast yellow layer.

The masking coupler can be any masking coupler suitable for use in a photographic element. Preferably the masking coupler has structure:

(16)

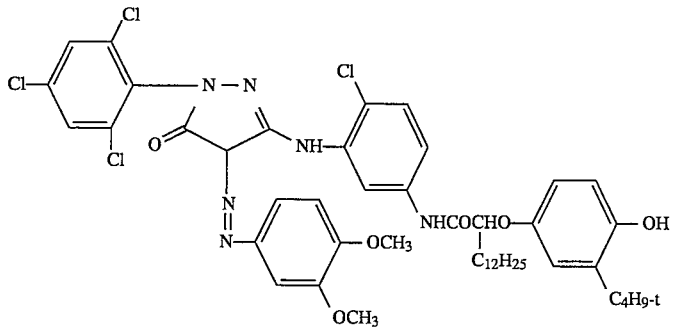

or

-continued (22)

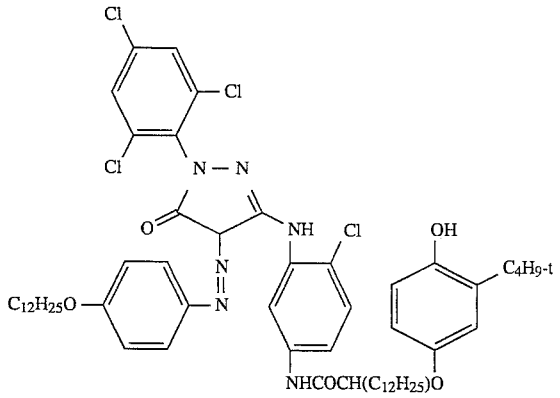

The masking coupler can be placed in any of the three magenta imaging layers.

The non-timed DIR coupler (B) used in the fast magenta layer can be any non-timed DIR coupler known in the photographic art. Examples of such non-timed DIR couplers are disclosed in U.S. Pat. No. 3,227,554 incorporated herein by reference. Preferred non-timed DIR couplers (B) have the structure:

A typical magenta image dye-forming coupler is a pyrazolotriazole. A preferred second image dye-forming coupler is coupler (34).

Coupler (14) is another preferred second magenta image dye forming coupler.

Suitable non-timed DIR couplers useful in the mid magenta layer are as described for the fast magenta layer and can be preferred coupler (B), for example.

(37)

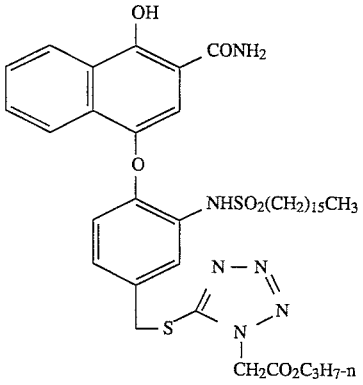

(B) (13)

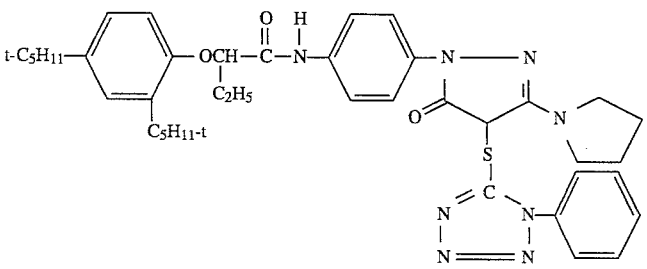

MID MAGENTA LAYER

The mid-magenta or mid green sensitive layer comprises at least one first magenta image dye-forming coupler, and preferably at least one second magenta image dye-forming coupler, preferably a non-timed DIR coupler and preferably a cyan dye-forming coupler (C).

The first magenta image dye-forming coupler can be coupler (A) referred to in the fast magenta layer.

The second magenta image dye-forming coupler can be any image forming coupler dye useful in the photographic art and can include the magenta image dye-forming coupler (A) referred to in the fast magenta layer.

The described cyan image dye-forming coupler (C) can be any cyan image dye-forming coupler known in the photographic art with its use in the magenta record herein referred to as a color correcting coupler. The cyan image dye-forming coupler is typically a phenol or naphthol coupler described in such representative patents and publications as noted herein.

Preferred cyan image dye-forming couplers (C) for the mid magenta layer have the structures:

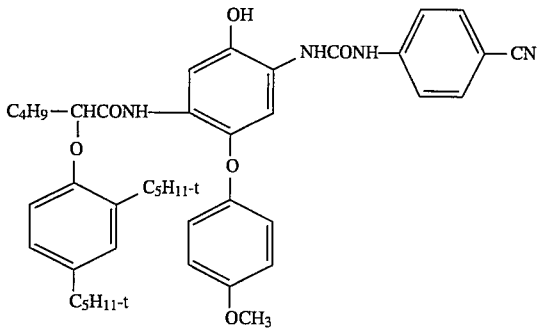

(38)

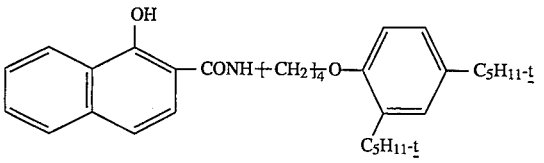

(39)

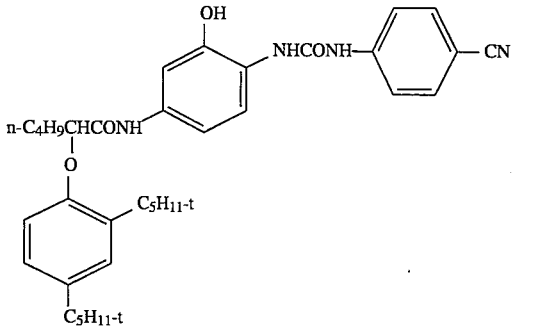

(4)

$$COUP\text{+}T^2\text{+}_m S—R^3—R^4$$

wherein

COUP is a coupler moiety as described, typically a cyan, magenta or yellow dye-forming coupler moiety;

$T^2$ is a timing group known in the photographic art, typically a timing group as described in U.S. Pat. Nos. 4,248,962 and 4,409,323, the disclosures of which are incorporated herein by reference;

m is 0 or 1;

$R^3$ is an alkylene group, especially a branched or straight chain alkylene group, containing 1 to 8 carbon atoms; and $R^4$ is a water-solubilizing group, preferably a carboxy group.

Typical bleach accelerator releasing couplers are described in, for example, European Patent 193,389, the disclosure of which is incorporated herein by reference.

A suitable bleach accelerator releasing coupler has the structure:

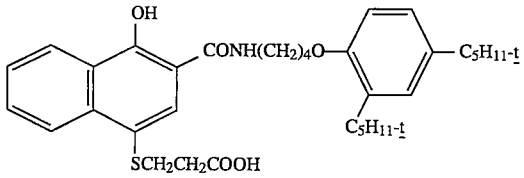

(21)

A preferred bleach accelerator releasing coupler has the structure:

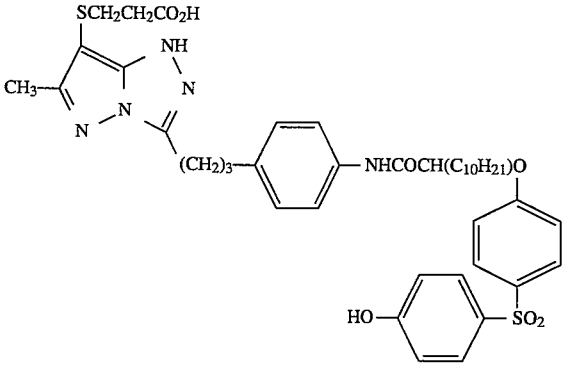

(12)

Coupler (21) may also be used in the mid magenta layer.

SLOW MAGENTA LAYER

The slow magenta layer contains at least one magenta image dye-forming coupler which is preferably a bleach accelerating releasing coupler (BARC). The slow magenta layer also contains a development inhibiting releasing coupler (DIR) preferably a non-timed DIR.

The bleach accelerator releasing coupler can be any bleach accelerator releasing coupler known in the photographic art. Combinations of such couplers are also useful. The bleach accelerator releasing coupler can be represented by the formula:

Combinations of bleach accelerating couplers may be used. The bleach accelerating coupler can be used in the other imaging layer including the magenta imaging layers.

The DIR coupler for the slow magenta layer can be the same coupler (B) used for the fast magenta or mid magenta layer.

An interlayer may be added between the fast and mid or mid and slow magenta layers.

Cyan dye-forming coupler (C) may be used in the slow magenta layer as in the mid magenta layer.

INTERLAYER

The interlayer between the slow magenta and the fast cyan layers can contain an oxidized developer scavenger or dyes that are added to adjust photographic speed or density of the film. A preferred oxidized developer scavenger is as described for the yellow filter layer. The dyes can be the same as for the UV layer and an additional dye which is useful in this layer can include coupler (11).

FAST CYAN LAYER

The fast cyan or most red sensitive layer contains a cyan image dye-forming coupler (C), a first non-timed DIR coupler, preferably a second non-timed DIR coupler, a masking coupler and a yellow image dye-forming correcting coupler.

The cyan image dye-forming coupler (C) useful in the fast cyan layer is as described for the mid magenta layer. The preferred cyan image dye-forming coupler is the same preferred coupler (C) as for the mid magenta layer.

The first and second non-timed DIR couplers in the fast cyan layer or most red sensitive layer can be any development inhibitor releasing coupler known in the photographic art. Typical DIR couplers are described in, for example, U.S. Pat. Nos. 3,227,554; 3,384,657; 3,615,506; 3,617,291; 3,733,201 and U.K. 1,450,479. Such DIR couplers upon oxidative coupling preferably do not contain a group that times or delays release of the development inhibitor group. The DIR coupler is typically represented by the formula:

COUP—INH wherein COUP is a coupler moiety and INH is a releasable development inhibitor group that is bonded to the coupler moiety at a coupling position. The coupler moiety COUP can be any coupler moiety that is capable of releasing the INH group upon oxidative coupling.

The coupler moiety (COUP) is, for example, a cyan, magenta or yellow forming coupler known in the photographic art. The COUP can be ballasted with a ballast group known in the photographic art. The COUP can also be monomeric, or it can form part of a dimeric, oligomeric or polymeric coupler, in which case more than one inhibitor group can be contained in the DIR coupler.

The releasable development inhibitor group (INH) can be any development inhibitor group known in the photographic art. Illustrative INH groups are mercaptotetrazoles, selenotetrazoles, mercaptobenzothiazoles, selenobenzothiazoles, mercaptobenzimidazoles, selenobenzimidazoles, mercaptobenzoxazoles, selenobenzoxazoles, mercaptooxadiazoles, mercaptothiadiazoles, benzotriazoles, and benzodiazoles. Preferred inhibitor groups are mercaptotetrazoles and benzotriazoles. Particularly preferred inhibitor groups are described in for example U.S. Pat. Nos. 4,477,563 and 4,782,012.

Preferred DIR couplers within COUP—INH are coupler (37) and:

(9)

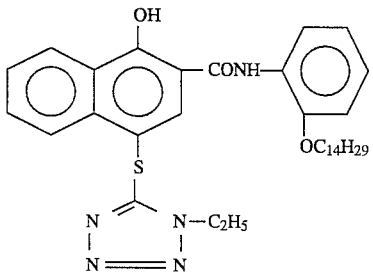

Timed DIR couplers which may be used in this layer have the structures of couplers (24), (27) and (28) and (5)

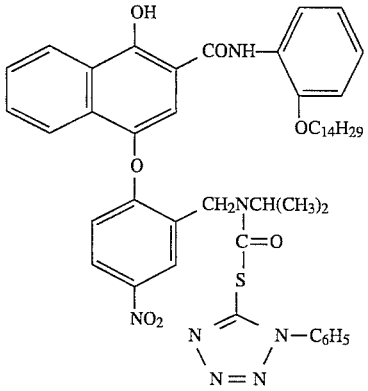

The second non-timed DIR coupler which may be used in the fast cyan layer has the structure.

(8)

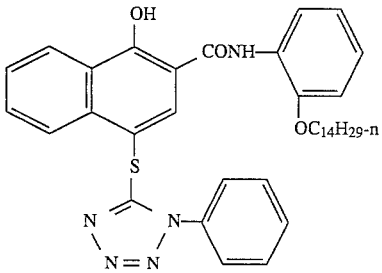

A further second non-timed DIR coupler which may be used in the fast cyan layer has the structure of coupler (37).

The masking coupler in the most red sensitive layer is typically a cyan dye-forming masking coupler, such as a naphthol cyan dye-forming masking coupler.

A preferred cyan dye-forming masking coupler for the cyan dye-forming layers of the photographic element is:

(7)

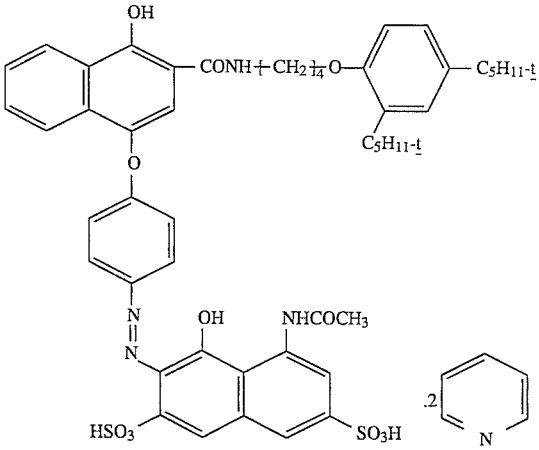

The yellow image dye-forming coupler can be any such coupler useful in the photographic art with its use in the cyan record sometimes referred to as a color correcting coupler. Couplers that are yellow dye forming couplers are typically acylacetamides, such as benzoylacetanilides and pivalylacetanilides as noted. Such couplers are described in such representative patents and publications as noted earlier.

The yellow dye-forming coupler is preferably a pivalylacetanilide comprising a phenoxy coupling off group. Such yellow dye-forming couplers have the same structures as used in the slow yellow layer and the preferred coupler is coupler (6).

SLOW CYAN LAYER

The slow cyan or less sensitive red layer contains a cyan image dye-forming coupler (C), a timed DIR coupler or development inhibitor anchimeric releasing coupler (DIAR), a non-timed DIR coupler, and a yellow image dye-forming correcting coupler.

The cyan image dye-forming coupler can be the same cyan image dye-forming coupler (C) as used in the fast cyan layer. Also, the yellow image dye-forming correcting coupler can be the same yellow image dye-forming coupler as used in the fast cyan layer.

An illustrative development inhibitor releasing coupler containing at least one timing group (T) that enables timing of release of the development inhibitor group preferably has the structure of coupler (5).

The non-timed DIR coupler can be the same as for the fast cyan layer.

INTERLAYER

An interlayer is provided between the slow cyan layer and the antihalation layer. The interlayer can contain an oxidized developer scavenger. A preferred oxidized developer scavenger is as described for the yellow filter layer. This interlayer solves a problem of increased fog resulting from interaction of bleach accelerating releasing coupler with silver in the antihalation layer. Thus, providing this interlayer between a BARC containing layer anywhere in the element and the antihalation layer so as to isolate the antihalation layer from layers containing dye-forming couplers, permits the advantageous use of a BARC for good silver bleaching without increasing fog or Dmin with respect to the antihalation layer, for example, while maintaining desired acutance.

ANTIHALATION LAYER

The antihalation layer can contain very fine gray or black silver filamentary or colloidal silver, e.g. CLS, and preferably a UV absorbing dyes, gelatin and colored dyes such as coupler (11) to provide density to the film.

While the antihalation layer has been described with respect to silver, other materials can be substituted for or used in conjunction with the silver. That is, instead of using finely divided silver in the antihalation layer, filter dyes such as washout-dyes or decolorizing dyes of the type referred to herein may be used. When filter dyes are used in the antihalation layer, the interlayer adjacent the antihalation layer may be omitted. Oxidized developer scavenger may be omitted from the antihalation layer when filter dyes are used. Examples of dyes which may be used in the antihalation layer are described in U.S. Pat. No. 4,923,788 as noted earlier.

Bleach accelerating silver salts as described with respect to the yellow filter layer may be used in the antihalation layer in conjunction with the finely divided silver. When bleach accelerating silver salts are used in antihalation it is preferred to use the interlayer over the antihalation layer as noted to minimize fog or Dmin.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be negative-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) development modifiers (see Research Disclosure Section XXI) surfactants and coating aids.

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image.

Development is followed by the conventional steps of bleaching, fixing, or bleach-fixing, to remove silver and silver halide, washing and drying.

EXAMPLE I

A three color photographic film was prepared as follows using conventional surfactants, antifoggants and the materials indicated. After providing a developable image and then processing in accordance with the Kodak C-41 process (British Journal of Photographic, pp. 196–198 (1988)) excellent results e.g. improved color, sharpness, granularity and neutral scale, were obtained. All silver halide emulsions were stabilized with 1.75 gm 4-hydroxy-6-methyl-1,3,3a,7-tetraazaindene per mole of silver. All silver halide emulsions were sensitized with the appropriate spectral red, green and blue sensitizing dyes.

| Support | mg/m² | mg/ft² | |
|---|---|---|---|
| Layer 1 | | | |
| Antihalation Layer | 215 | 20 | Black colloidal silver |
| | 91 | 8.5 | UV absorbing dye coupler (1) |
| | 91 | 8.5 | UV absorbing dye coupler (2) |
| | 14.3 | 13 | Blue filter dye (11) |
| | 2422 | 225 | Gelatin |
| Layer 2 | | | |
| Interlayer | 54 | 5.0 | D-Ox scavenging compound (3) |
| | 861 | 80.0 | Gelatin |
| Layer 3 | | | |
| Least Red Sensitive Layer | 915 | 85 | Red sensitized silver iodobromide emulsion (4.5% iodide, tabular grains with average grain diameter 1.1 micron and average grain thickness 0.1 micron), |
| | 1238 | 115 | Red sensitized silver iodobromide emulsion (0.5% iodide, cubic grains with average edge length 0.21 microns) |
| | 603 | 56 | Cyan dye forming image coupler (4) |
| | 36 | 3.3 | Cyan dye forming development inhibitor release (DIR) coupler (5) |
| | 86 | 8.0 | Yellow dye-forming image coupler (6) |
| | 3078 | 286 | Gelatin |
| Layer 4 | | | |
| Most Red-Sensitive Layer | 1291 | 120 | Red sensitized silver iodobromide emulsion (3% iodide, octahedral grains with average grain diameter 0.90 micron) |
| | 54 | 5.0 | Cyan dye-forming image coupler (4) |
| | 32.3 | 3 | Cyan dye-forming masking coupler (7) |
| | 50 | 4.6 | Cyan dye-forming DIR coupler (9) |
| | 11 | 1.0 | Yellow dye-forming image coupler (6) |
| | 2368 | 220 | Gelatin |
| | 4.3 | 0.4 | Cyan dye-forming DIR coupler (8) |
| Layer 5 | | | |
| Interlayer | 129 | 12 | Oxidized development scavenger coupler (3) |
| | 861 | 80 | Gelatin |
| | 11 | 1 | Green filter dye (10) |
| | 49 | 4 | Blue filter dye (11) |
| Layer 6 | | | |
| Least Green-Sensitive Layer | 124 | 15 | Green sensitized silver iodobromide emulsion (3% iodide, tabular grains with average grain diameter 0.8 micron, and average grain thickness 0.1 micron) |
| | 592 | 55.0 | Green sensitized silver iodobromide emulsion (0.5% iodide, tabular gains with average grain diameter 0.5 and average grain thickness 0.1 micron) |
| | 161 | 15.0 | Magenta dye-forming image coupler that releases a bleach accelerating fragment (12) |
| | 12 | 1.1 | Magenta dye-forming DIR coupler (13) |
| | 1507 | 140 | Gelatin |
| Layer 7 | | | |
| Mid Green-Sensitive Layer | 969 | 90.0 | Green sensitized silver iodobromide emulsion (3% iodide, tabular grains with average grain diameter 0.8 micron and average grain thickness 0.1 micron) |
| | 75.0 | 7.0 | Magenta dye-forming image coupler (14) |
| | 54.0 | 5.0 | Magenta dye-forming image coupler (15) |
| | 9.0 | 0.8 | Magenta dye-forming DIR coupler (13) |
| | 11.0 | 1.0 | Cyan dye forming, image coupler (4) |
| | 1238 | 115.0 | Gelatin |
| Layer 8 | | | |
| Most Green-Sensitive Layer | 753.0 | 70.0 | Green sensitized silver iodobromide emulsion (6% iodide, tabular grains with average grain diameter 1.0 micron and average grain thickness 0.1 micron) |
| | 22.0 | 2.0 | Magenta dye-forming image coupler (15) |
| | 13.0 | 1.2 | Magenta dye-forming DIR coupler (13) |
| | 65.0 | 6.0 | Magenta dye-forming development masking coupler (16) |
| | 26.0 | 2.4 | Yellow dye-forming DIR coupler (17) |
| | 969 | 90.0 | Gelatin |
| Layer 9 | | | |
| Interlayer | 75.0 | 7.0 | D-Ox scavenging coupler (3) |
| | 194.0 | 18.0 | Developer bleachable yellow filter dye (18) |
| | 861.0 | 80.0 | Gelatin |
| Layer 10 | | | |
| Least Blue-Sensitive Layer | 215.0 | 20.0 | Blue sensitized silver iodobromide emulsion (6% iodide, octahedral grains with average grain diameter of 0.65 micron) |
| | 129.0 | 12.0 | Blue sensitized silver iodobromide emulsion (5% iodide, octahedral grains with average grain diameter of 0.40 micron) |
| | 258.0 | 24.0 | Blue sensitized silver iodobromide emulsion (5% iodide, octahedral grains with average |

-continued

| Support | mg/m² | mg/ft² | |
|---|---|---|---|
| | | | grain diameter of 0.23 micron) |
| | 11.0 | 97.0 | Yellow dye-forming image coupler (19) |
| | 1420 | 132.0 | Gelatin |
| Layer 11 | | | |
| Most Blue-Sensitive Layer | 377.0 | 35.0 | Blue sensitized silver iodobromide emulsion (6% iodide, octahedral grains with average grain diameter of 1.0 micron) |
| | 11.0 | 1.0 | Yellow dye-forming DIR coupler (17) |
| | 1076 | 100.0 | Gelatin |
| Layer 12 | | | |
| First Protective Layer | 215.0 | 20.0 | Unsensitized silver bromide Lippman emulsion (0.04 microns) |
| | 108.0 | 10.0 | UV absorbing dye (1) |
| | 129.0 | 12.0 | UV absorbing dye (2) |
| | 753.0 | 70.0 | Tricresyl phosphate |
| | 1345 | 125.0 | Gelatin |
| | 40 | 0.4 | Green absorbing dye (10) |
| | 20 | 0.2 | Red absorbing dye (20) |
| Layer 13 | | | |
| Second Protective Layer | 44.0 | 4.1 | Matte polyvinyltoluene beads |
| | 883.0 | 82.0 | Gelatin |

EXAMPLE II

A three color photographic film was prepared as follow using conventional surfactants, antifoggants and the materials indicated to illustrate the improvement in fog reduction using interlayers in conjunction with the finely divided silver layer, e.g. antihalation layer. After providing a developable image and the element was processed in accordance with the Kodak C-41 process (British Journal of Photographic, pp. 196–198 (1988).

| Support | mg/m² | mg/ft² | |
|---|---|---|---|
| Layer 1 | | | |
| Antihalation Layer | 183 | 17 | Black colloidal silver |
| | 91 | 8.5 | UV absorbing dye coupler (1) |
| | 2422 | 225 | Gelatin |
| | 140 | 13 | Blue absorbing dye (11) |
| Layer 2 | | | |
| Interlayer | 161 | 15 | D-Ox scavenging compound (3) |
| | 861 | 80.0 | Gelatin |
| Layer 3 | | | |
| Least Red Sensitive Layer | 570 | 53 | Red sensitized silver iodobromide emulsion (4.5% iodide, tabular grains with average grain diameter 1.1 micron and average grain thickness 0.1 micron) |

-continued

| Support | mg/m² | mg/ft² | |
|---|---|---|---|
| | 2013 | 187 | Red sensitized silver iodobromide emulsion (0.5% iodide, cubic grains with average edge length 0.21 microns) |
| | 54 | 5.0 | Cyan dye forming DIR coupler (8) |
| | 430 | 40 | Cyan dye-forming image coupler (4) |
| | 97 | 9.0 | Cyan dye-forming coupler that releases a bleach accelerating fragment (21) |
| | 2691 | 250 | Gelatin |
| Layer 4 | | | |
| Most Red-Sensitive Layer | 1291 | 120 | Red sensitized silver iodobromide emulsion (3% iodide, octahedral grains with average grain diameter 0.90 micron) |
| | 38 | 3.5 | Cyan dye-forming DIR coupler (9) |
| | 4 | 0.4 | Cyan dye-forming DIR coupler (8) |
| | 32 | 3.0 | Cyan dye-forming masking coupler (7) |
| | 102 | 9.5 | Cyan dye-forming image coupler (4) |
| | 2368 | 220 | Gelatin |
| Layer 5 | | | |
| Interlayer | 43 | 4 | Oxidized development scavenger coupler (3) |
| | 861 | 80 | Gelatin |
| | | | Green filter dye (10) |
| | | | Blue filter dye (11) |
| Layer 6 | | | |
| Least Green-Sensitive Layer | 926 | 86 | Green sensitized silver iodobromide emulsion (3% iodide, tabular grains with average grain diameter 0.8 micron, and average grain thickness 0.1 micron) |
| | 538 | 50 | Green sensitized silver iodobromide emulsion (0.5% iodide, tabular gains with average grain diameter 0.5 and average grain thickness 0.1 micron) |
| | 22 | 2 | Magenta dye-forming masking coupler (22) |
| | 4.3 | 0.4 | Magenta dye-forming DIR coupler (13) |
| | 2422 | 225 | Gelatin |
| | 678 | 63 | Magenta dye-forming image coupler (14) |
| Layer 7 | | | |
| Most Green-Sensitive Layer | 1345 | 125 | Green sensitized silver iodobromide emulsion (6% iodide, tabular grains with average grain diameter 1.0 micron and average grain thickness 0.1 micron) |
| | 113 | 10.5 | Magenta dye-forming image coupler (15) |
| | 4.3 | 0.4 | Magenta dye-forming DIR coupler (13) |

-continued

| Support | mg/m² | mg/ft² | |
|---|---|---|---|
| | 43 | 4.0 | Magenta dye-forming masking coupler (22) |
| | 73 | 7.0 | Yellow dye-forming DIR coupler (17) |
| | 1722 | 160 | Gelatin |
| Layer 8 | | | |
| Interlayer | 75.0 | 7.0 | D-Ox scavenging coupler (3) |
| | 194.0 | 18.0 | Developer bleachable yellow filter dye (18) |
| | 861.0 | 80.0 | Gelatin |
| Layer 9 | | | |
| Least Blue-Sensitive Layer | 280 | 26 | Blue sensitized silver iodobromide emulsion (6% iodide, octahedral grains with average grain diameter of 0.65 micron) |
| | 387 | 36 | Blue sensitized silver iodobromide emulsion (5% iodide, octahedral grains with average grain diameter of 0.40 micron) |
| | 1238 | 115 | Yellow dye-forming image coupler (19) |
| | 1420 | 132.0 | Gelatin |
| Layer 10 | | | |
| Most Blue-Sensitive Layer | 430 | 40 | Blue sensitized silver iodobromide emulsion (6% iodide, octahedral grains with average grain diameter of .90 micron) |
| | 24 | 2.2 | Yellow dye-forming DIR coupler (17) |
| | 1076 | 100.0 | Gelatin |
| | 54 | 5 | Yellow dye-forming image coupler (19) |
| Layer 11 | | | |
| First Protective Layer | 215.0 | 20.0 | Unsensitized silver bromide Lippman emulsion (0.04 microns) |
| | 108.0 | 10.0 | UV absorbing dye (1) |
| | 10.8 | 10.0 | UV absorbing dye (2) |
| | 108 | 100 | Tricresyl phosphate |
| | 1345 | 125.0 | Gelatin |
| Layer 12 | | | |
| Second Protective Layer | 44.0 | 4.1 | Matte polyvinyltoluene beads |
| | 883.0 | 82.0 | Gelatin |

The following tests were run to illustrate the advantage of an interlayer using the layer structure of Example II.

TABLE I

| Specimen | AHU (mg/ft2) Gray Silver | AHU**/SC* interlayer | BARC location above AHU (coupler) | Red Dmin |
|---|---|---|---|---|
| 1 | 0 | none | none | 0.166 |
| 2 | 17 | none | none | 0.215 |
| 3 | 0 | none | 9 mg in (21) SC* | 0.209 |
| 4 | 17 | none | 9 mg (21) in SC* | 0.381 |
| 5 | 17 | none | 12 mg (21) in SC* | 0.412 |

TABLE I-continued

| Specimen | AHU (mg/ft2) Gray Silver | AHU**/SC* interlayer | BARC location above AHU (coupler) | Red Dmin |
|---|---|---|---|---|
| 6 | 17 + 15 mg compound (3) | none | 9 mg (21) in SC* | 0.326 |
| 7 | 17 | 80 gel + 15 compound (3) | 9 mg (21) in SC* | 0.202 |
| 8 | 17 | none | 12 mg (12) in SM*** | 0.226 |

*Slow cyan layer
**Antihalation layer
***Slow magenta layer

It will be seen from Table I that when a BARC is present in the element the addition of an interlayer between the antihalation layer (AHU) and a layer containing a dye forming coupler lowers the Dmin significantly.

EXAMPLE III

Photographic elements having the layer structure as shown in Example II were prepared to illustrate the improvement in red Dmin when the photographic element was prepared using bleach accelerating silver salts (BASS) in accordance with the invention.

TABLE II

| Bleach Accelerator | Interlayer between SC/AHU | Actual Red DMin | Normalized Red Dmin |
|---|---|---|---|
| 5-7 None | None | 0.407 | 0 (check) |
| 5-4 Coupler (21) (BARC in SC) | None | 0.464 | +0.054 |
| 5-8 Ag-MPA (BASS in AHU) | None | 0.500 | 0.093 |
| 4-2 None | Yes | 0.153 | 0 (check) |
| Ag-MPA (BASS in AHU) | Yes | 0.162 | +0.009 |

As will be seen from Table II, in one example (5–7), the element was prepared without a bleach accelerator releasing coupler and without an interlayer to isolate the antihalation layer containing finely divided silver. Table II shows that the normalized red Dmin is zero (0).

In the second example (5–4), the element was prepared and a bleach accelerating releasing coupler was used in the slow cyan (SC) layer. However, no interlayer was used between the antihalation layer and the remainder of the element. It will be noted that the normalized red Dmin increases to 0.054.

In a third example (5–8), a silver salt of mercapto proprionic acid ($AgSCH_2CH_2COOH$) was used in the antihalation and no interlayer was used between the antihalation layer and the remainder of the element. The normalized red Dmin increased to 0.093.

In a fourth example (4-2), no bleach accelerating releasing coupler was used in the element and an interlayer was positioned between the antihalation layer and the remainder of the element. The normalized red Dmin was zero (0).

Lastly, in this example (4—4), silver salt of mercapto proprionic acid was used in the antihalation layer and an interlayer was positioned between antihalation layer and the remainder of the element. The amount of normalized red Dmin was reduced to a level of 0.009.

Thus, when bleach accelerating silver salts are used in an antihalation layer containing finely divided silver, surprisingly the interlayer provided between the antihalation layer and the remainder of the element has the effect of markedly reducing the red Dmin.

EXAMPLE IV

This example was prepared to illustrate the advantage of reduced fog when providing an interlayer between a filter layer containing finely divided silver and a bleach accelerating releasing coupler. The photographic element used was substantially the same as in Example I except finely divided silver was used in the yellow filter layer, an interlayer was provided above and below the finely divided silver layer, and bleach accelerating releasing couplers were provided in the slow yellow, fast magenta, and the mid magenta illustrated as follows:

| |
|---|
| SOC |
| UV |
| FY |
| SY +/– BARC |
| +/– IL |
| CLS |
| +/– IL |
| FM +/– BARC |
| MM +/– BARC |
| SM |
| IL |
| FC |
| SC |
| IL |
| AHU |
| /////// |

The data provided in Table III show the results of incorporating the finely divided silver layer (CLS layer) with an interlayer below and/or above the CLS layer.

TABLE III

| # | mg/ft2 BARC (location) | Inter-layers Above CLS | Inter-layers Below CLS | B Dmin* | G Dmin* |
|---|---|---|---|---|---|
| 11 | None | None | None | Check (0) | Check (0) |
| 12 | 5 mg (21) in SY** | None | None | +0.070 | +0.168 |
| 3 | 5 mg (21) in SY** | None | Yes | +0.031 | –0.013 |
| 2 | 5 (21) in SY** | Yes | Yes | –0.209 | –0.108 |
| 9 | 5 (21) in FM*** | None | None | +0.096 | +0.150 |
| 6 | 5 mg (21) in FM*** | None | Yes | +0.033 | –0.073 |
| 10 | 12 mg (12) in MM**** | None | None | –0.020 | –0.025 |
| 5 | 12 mg (12) in MM**** | None | Yes | –0.023 | –0.120 |

*Normalized
**Slow yellow
***Fast magenta
****Mid magenta

From Table III it will be seen that the addition of BARC compounds to a film element containing colloidal silver (CLS) in a non-imaging layer caused significant Dmin increase in layers that contain dye forming couplers adjacent the CLS layer. Addition of interlayers to isolate the CLS layer from layers containing dye forming couplers significantly reduced the Dmin resulting from the use of BARC compounds in the presence of the CLS layer.

The invention has been described in detail with particular reference to particular embodiments thereof, but it will be understood that variations and modifications can be effected within the spirit and scope of the invention.

What is claimed is:

1. A multilayer color photographic element comprising a support having coated thereon photographic silver halide emulsion layers comprising blue sensitive, green sensitive and red sensitive layers; the photographic element comprising:

a) at least one of a bleach accelerating releasing coupler and a bleach accelerating silver salt in at least one layer of the photographic element;

b) a layer containing finely divided silver; and c) an interlayer containing an oxidized developer scavenger, disposed between the layer containing finely divided silver and a layer containing dye forming coupler.

2. The photographic element in accordance with claim 1 wherein the interlayer is contiguous said layer containing said finely divided silver.

3. The photographic element in accordance with claim 1 wherein said photographic element contains a second interlaver located on the side of said layer containing finely divided silver opposite to the location of said "interlaver disposed between said layer containing finely divided silver and said layer containing dye forming coupler".

4. The photographic element in accordance with claim 3 wherein the interlayers are contiguous said layer containing the finely divided silver.

5. The photographic element in accordance with claim 1 wherein said layer containing finely divided silver is an antihalation layer.

6. The photographic element in accordance with claim 1 wherein said layer containing finely divided silver is a yellow filter layer.

7. A multilayer color photographic element comprising a support having coated thereon photographic silver halide emulsion layers comprising blue sensitive, green sensitive and red sensitive layers; the photographic element comprising:

a) at least one of a bleach accelerating releasing coupler and a bleach accelerating silver salt in at least one layer of the photographic element;

b) an antihalation layer adjacent said support, the antihalation containing finely divided silver; and c) an interlayer containing an oxidized developer scavenger, contiguous said antihalation layer and being interposed between said antihalation and the layer containing said bleach accelerating releasing coupler.

* * * * *